US005239794A

United States Patent [19]

Klein

[11] Patent Number: 5,239,794

[45] Date of Patent: Aug. 31, 1993

[54] HABITABLE STRUCTURE WITH WATER CATACHMENT, STORAGE AND DISTRIBUTION

[76] Inventor: John M. Klein, P.O. Box 751, Southeastern, Pa. 19399

[21] Appl. No.: 875,875

[22] Filed: Apr. 29, 1992

[51] Int. Cl.[5] ..... E02D 15/04

[52] U.S. Cl. ..... 52/169.6; 210/167; 52/20; 52/21; 52/19; 52/16

[58] Field of Search ..... 52/19, 20, 21, 169.6, 52/16; 210/167

[56] References Cited

U.S. PATENT DOCUMENTS

| | | | |
|---|---|---|---|
| 1,460,613 | 7/1923 | Sill . | |
| 3,227,061 | 1/1966 | Swayze | 52/169.6 |
| 4,161,186 | 7/1979 | Sitarz . | |
| 4,162,218 | 7/1979 | McCormick | 210/167 |
| 4,228,006 | 10/1980 | Hanna | 210/167 |
| 4,615,158 | 10/1986 | Thornton | 52/169.6 |
| 4,717,285 | 1/1988 | Pulkkinen | 52/169.6 |
| 4,726,151 | 2/1988 | Vitale . | |
| 4,934,404 | 6/1990 | DeStefano . | |

FOREIGN PATENT DOCUMENTS

| | | | |
|---|---|---|---|
| 2589899 | 5/1987 | France | 52/169.6 |
| 0190841 | 11/1982 | Japan | 52/169.6 |
| 0190840 | 11/1992 | Japan | 52/169.6 |
| 2077804 | 12/1981 | United Kingdom | 52/169.6 |

*Primary Examiner*—David A. Scherbel
*Assistant Examiner*—Wynn E. Wood
*Attorney, Agent, or Firm*—Panitch Schwarze Jacobs & Nadel

[57] ABSTRACT

A habitable structure has a ground-supported, water-impervious floor and upright foundation walls which together define an open top water enclosure. Flooring is supported on the foundation walls essentially covering the open top. Roofing is supported above the flooring so as to define a habitable space between the roofing and the flooring above the enclosure. A catchment system collects rainwater from the roofing and other sources and conducts it into the enclosure where it is stored for future use. The enclosure formed by the foundation walls and floor is modified to permit use as either a water storage tank or habitable area itself.

19 Claims, 2 Drawing Sheets

HABITABLE STRUCTURE WITH WATER CATACHMENT, STORAGE AND DISTRIBUTION

FIELD OF THE INVENTION

The invention relates to habitable structures and, more particularly, with respect to water catchment, storage and distribution systems used with habitable structures.

BACKGROUND OF THE INVENTION

In many area of this country, the development of real estate has been hindered or blocked due to the unavailability of on-site water.

For example, in certain prime residential areas around San Francisco, county officials will not issue housing construction permits because of the lack of piped-in water and the absence of accessible ground water. The same problems hinder development in many arid areas such as the southwestern United States, the Virgin Islands and elsewhere.

Similar problems exist in other locations. For example, in certain areas of the Hawaiian Islands and other locations, rainwater is plentiful, or at least adequate to support habitation, but piped-in water and ground water are unavailable due to expense, geology, contamination, etc.

Others have previously suggested the provision of tanks to collect rainwater, where available, for use in a habitable structure. However, exposed tanks like those disclosed in U.S. Pat. Nos. 1,760,613 and 4,726,151 are generally unsightly and can cover a relatively large portion of a tract. Moreover, the property in question may not be sufficiently large in area to contain both the habitable structure and the tank or to contain both and still comply with building or zoning codes. U.S. Pat. Nos. 4,228,006 and 4,934,404 disclose burying water storage tanks under or near a habitable structure. However, excavation may not be possible in some locations due to geology and may be a significant additional construction expense, even if possible.

The inability to provide adequate water in these cases has either prevented or limited the development of the property in question and has significantly depressed the market values of such properties. In some instances, properties which would be extremely valuable if they could be developed for habitable uses have been rendered almost worthless.

SUMMARY OF THE INVENTION

In its most basic form, the present invention is a ground-supported habitable structure comprising a foundation formed by one or more essential water-impervious vertical walls defining an essentially closed perimeter; a ground contacting, essentially water-impervious floor within the perimeter and defining with the foundation an open top water enclosure sitting on or at least partially in the ground. The structure further comprises flooring positioned on the foundation at least substantially covering the open top of the enclosure. The foundation supports an outer perimeter of the flooring and at least part of any load supported by the flooring. The structure further comprises roofing exposed to the elements and supported six feet or more over the flooring to provide a habitable space between the roofing and the flooring. The roofing and any load supported by the roofing is transmitted to the ground through the foundation. The structure further comprises a catchment supported to receive rainwater running from the roofing and at least one water-carrying conduit extending from the catchment to the enclosure interior so as to deposit rainwater running from the roof into the enclosure beneath the flooring.

BRIEF DESCRIPTION OF THE DRAWINGS

The foregoing Summary as well as the following Detailed Description of Preferred Embodiments are better understood when read in conjunction with the appended drawings. For the purpose of illustrating the invention, there is shown in the drawings embodiments which are presently preferred. It should be understood, however, that the invention is not limited to the specific methods and instrumentalities disclosed. In the drawing.

DESCRIPTION OF PREFERRED EMBODIMENTS

Figure 1:
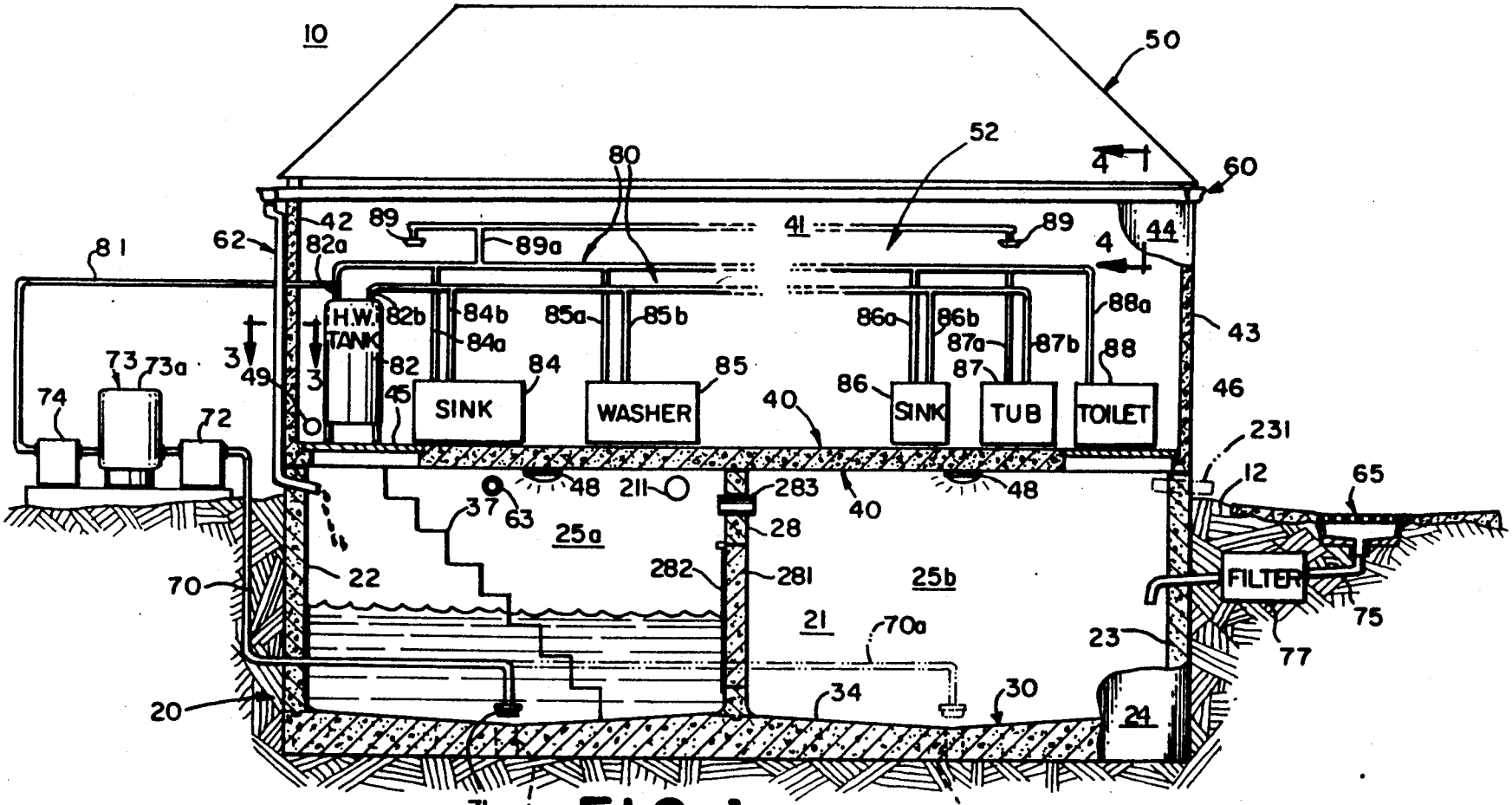
FIG. 1 is a diagrammatic broken-away elevational view of an exemplary, preferred embodiment, ground-supported, habitable structure of the present invention.

Certain terminology is used in the following description for convenience only with reference to the drawing and is not limiting. In addition, like numerals are used in the drawing to indicate like elements throughout.

There is shown in FIG. 1 a diagrammatic representation of a ground-supported habitable structure of the present invention indicated generally at 10. The structure 10 includes the ground contacting foundation, indicated generally at 20, a ground contacting, essentially water-impervious floor indicated generally at 30, flooring indicated generally at 40, which is positioned on the foundation 20 and roofing indicated generally at 50, which is exposed to the elements and supported six feet or more over the flooring 40 to provide a habitable space 52 between the roofing 50 and flooring 40. The depicted foundation 20 is formed by four, at least essentially water-impervious vertical walls 21–24 which are mutually perpendicularly positioned to define an essentially closed, rectangular perimeter. Foundation wall 21 is seen in the background of FIG. 1 extending perpendicularly between walls 22 and 23, which are seen in cross section. A fourth wall, which has been almost entirely broken away in FIG. 1, extends perpendicularly between walls 22 and 23, parallel to wall 21, and is spaced out of the plane of FIG. 1 from a wall 21 to define with the indicated walls 21, 22, 23, the essentially closed perimeter. The floor 30 contacts and is supported directly by the ground 12. Preferably, floor 30 in turn supports foundation walls 21–24. The floor 30 and foundation 20 together define an open-topped, water enclosure contacting and supported by the ground 12, the open top being at least essentially covered by the flooring 40. In the depicted embodiment, an at least generally water-impervious, vertical load-bearing partition wall 28 is further preferably provided extending between foundation walls 21 and 24. It defines with the floor 30 and foundation walls 21–24, two separate, adjoining open top water enclosures, which are indicated at 25*a* and 25*b*.

The roofing 50 is supported above the flooring 40 on four upper load-bearing walls 41, 42, 43 and 44. The roofing 50 and any load supported by the roofing is transmitted to the ground 12 at least through those upper walls 41–44 and the foundation walls 21–24. A catchment indicated generally at 60 is supported by one or more of the upper walls 41–44 and/or the roofing 50, or in other conventional ways, entirely around the roofing, so as to receive all rainwater running from the roofing 50. At least one water carrying conduit 62 is provided extending from the catchment 60 to the interior of the enclosure formed by foundation 20 and floor 30, in particular the enclosure 25*a*, so as to deposit rainwater running from the roofing into the enclosure beneath the flooring 40.

Preferably, the floor 30, foundation 20 and flooring 40 are all provided by poured reinforced concrete to surround the enclosure(s) 25*a*, 25*b* with strong, non-corroding or rotting materials. It is preferred in each instance that a keyway like keyway 33 be provided in an upper surface 34 of the floor 30 so as to receive a key 29 formed at the bottom of each separately poured foundation wall defining part of the enclosure. The key and key way prevent movement of water beneath the walls 21–24 and, in the case of partition wall 28, prevent movement of that wall across the floor 30 under hydraulic load.

Where concrete or other masonry is used to provide the ground contacting foundation 20 and floor 30, at least the inner facing surfaces of the foundation walls 21–24 and 28 and floor 30 are preferably finished with nontoxic materials which will render those surfaces and the wall essentially water impervious. For example, a stucco/mortar bonding agent such as Thorobond TM might be applied directly to the concrete surfaces, a coating 36 mortar, stucco or other concrete mortar mix applied to the surfaces and one or preferably two coats of a sealer 37 such as Thoroseal TM applied over the bonding agent and coating. Alternatively, some plastic coating material(s) or systems which may be applied directly to concrete may be found suitable for this purpose.

Preferably, all inner surfaces of the foundation walls 21–24 and 28 and the upper surface 34 of the floor 30 facing the interior of each enclosure 25*a*, 25*b* are configured to prevent stagnation and encourage drainage away from the vertical walls. For example, the aforesaid mortar or stucco material may be applied at the corners formed between each of the vertical foundation walls 21–24 and 28 and the upper surface 34 of the floor 30 can be built up and shaped to provide curved surfaces like surface 38 in FIG. 2. Similarly, intersections between adjoining, transverse vertical foundation walls, like the intersections between walls 22 and 21 and walls 28 and 21, are preferably provided in the same or a similar manner with vertically extending curved surfaces connecting the adjoining inner planar sides of those walls, like surface 39 in FIG. 3, eliminating any corners between those adjoining inner planar sides of any enclosure 25*a*, 25*b*.

The habitable structures of the present invention are designed and intended to remedy both potential short term and long-term water shortage and/or storage problems. Because the preferred structure 10 is sufficiently strong and durable to last literally hundreds of years, the structure 10 is further preferably modified during initial construction to render either or both enclosures 25*a*, 25*b* usable as additional habitable space when the water is not being stored. For that purpose, one and preferably two access ways 45 and 46 may be provided through the flooring 40 to permit access through the flooring 40 to either enclosure(s) 25(*a* and/or *b*). Preferably too, one or more stairways 37, for example, poured or precast concrete, plastic or coated metal stairway(s), are installed leading from each access way to the floor 30.

Preferably too, provisions are further made for inspecting and cleaning each enclosure from its access. First, lighting is preferably provided within each enclosure. In the depicted embodiment, separate fixtures 48 are included over each enclosure 25*a* and 25*b*. Also, suitable means such as a water suction coupling, indicated diagrammatically at 49, is positioned proximal the access way 45 to permit the coupling of a swimming pool sweep or other comparable water suction device to clean sediment from the upper surface 34 of the floor 30 through the access way 45. A similar coupling can be provided adjoining the second access way 46, if desired.

Since it may be desired at some future time to use the entire enclosure 25 as additional habitable space and permit passage through partition wall 28, a door opening 281 may be provided which preferably may be sealingly closed by means of a removable cover 282. If desired, similar openings might be provided through any of the perimeter walls 21–24 as future window or door openings. Also preferably provided through partition wall 28 are one or more overflow tubes 283. Each tube 283 will permit the water levels in the adjoining enclosures 25*a*, 25*b* to balance in the event that one reservoir should fill when the other does not. Each tube 283 may be closed, for example, by means of a cover on either end of the tube or an adjustable valve (neither depicted) in the tube, if enclosure 25*b* is to remain dry. Where only one enclosure 25*a* is being used to store water, preferably overflow piping 211 is also provided through one of the foundation walls 21, 22, 24 defining that enclosure 25*a*. Preferably, the overflow piping 211 has a collective cross-sectional area at least as great as the cross-sectional area of the inlet conduit 62 to drain water from near the top of the enclosure 25*a* at least as quickly as the enclosure of 25*a* can be filled. The piping 211 is preferably covered at its outer end with a fine screen that permits water to flow out of the enclosure 25*a* but prevents vermin and other like potential contaminating elements from passing back into the enclosure 25*a*.

In addition to collecting and directing water from the roofing of the habitable structure 10 into its foundation, where necessary or desirable, water from the roofs of ancillary and outbuildings can also be collected and conducted to the enclosure 25*a*. For example, an inlet like inlet 63, indicated diagrammatically, can be provided with appropriate valves and fittings to receive a hose to add water to the enclosure 25*a* from another separate source, such as a tank truck. Alternatively or in addition, water can be pumped through piping 211. In addition, if desired, sources of clean runoff water from the ground may also be collected by suitable means. For example, a drain 65 in a paved area collects water which is carried by suitable underground conduit(s) 75 to the enclosure 25*b* where it may be stored separately from the intended pottable water supply enclosure 25*a* for secondary uses, such as outside washing, irrigation, fire protection, etc. An appropriate filter 77 can be provided to initially clean the water to the degree desired for its intended storage and use.

Water may be removed from each enclosure by suitable, conventional means. In the indicated preferred embodiment, a removal pipe 70 is extended into the enclosure 25*a* with its open end location proximal the enclosure floor 30 to draw off water from near the bottom of the enclosure. A screen 71 may be installed at the inlet of the pipe to prevent the pickup of large, solid debris. The outlet end of pipe 70 is coupled to a suction-type water pump 72. The outlet of the suction pump is preferably coupled to the inlet of a pressure pump 73. The outlet of pressure pump 73 is preferably coupled to a filtration device 74. The outlet of filtration device 74 is coupled to the inlet end of a pottable water conduit distribution system within the structure 10, which is indicated generally at 80. The conduit system 80 includes a pressurized cold water feed line 81 from the outlet of the filtration device 74 having a number of sub-branches 82*a*, 84*a*, 85*a*, 86*a*, 87*a*, 88*a* and 89*a*, which carry the cold water to various fixtures within the enclosure including hot water tank 82, kitchen sink 84, clothes washer 85, and bathroom sink 86, tub 87, a toilet 88 and fire sprinklers 89, respectively. A separate hot water line 83 from the tank 82 also is provided with branches 84*b*, 85*b*, 86*b* and 87*b* routed to the respective indicated fixtures. Pressure pump 73 is of the type which includes an inverted, sealed tank having an inlet and outlet at the bottom end and retains a pocket of air or other gas(es) which is compressed by the water being fed under pressure into the tank 73*a* from pump 72. The compressed air or other gas(es) in tank 73*a* forces water from the bottom of the tank 73*a* through the filtration device 74 and the conduit system 80. An ozone generator, chlorinator or other conventional water disinfecting device may be coupled with the tank 73*a*, filter 74 or to another portion of the water distribution system for further safety, if desired.

In addition to the basic features of the system which have been shown and described, a number of ancillary features may be useful. For example, appropriate coupling, as is indicated at 81*a*, with a valve and female threaded spigot can be provided for outdoor use and for feeding externally pressurized water into the system, for example, from an auxiliary pump (not depicted). For example, valving which might be provided along conduits 62, 75 or conduit system 80, to vary or stop water flow therethrough, have been omitted from the figures. It might be quite desirable to include a bypass valve in conduit 62 to divert water from the conduit 62 onto the ground when the enclosure 25*a* has reached a desired maximum level or when the foundation is no longer used for water storage. Similarly, a shutoff or bypass valve along conduit 75 would be useful to prevent undesired water from entering enclosure 25*b*. In addition, it may be desirable to include a self-closing, timed shutoff valve on each of the feed lines 84*a*–88*a* and 84*b*–87*b* flowing more than a predetermined period of time through the conduit in the event of a faucet left open or a valve within a washer or toilet malfunction. Other conduit systems can be provided within the structure 10. For example, an internal water sprinkler system 89 can be provided, if desired, as a branch of conduit 81 or, alternatively, from the drain water enclosure 25*b*, preferably with its own pump. It may be desirable to have an auxiliary power supply to power pump 72 or any other electrically powered appliance or motor in the event of a power outage during an emergency. Pump 72 can be used as the vacuum source 49 by the provision of suitable piping and valving. A separate branch 70*a* of the removal pipe 70 can be provided extending into enclosure 25*b*, with suitable diverting and/or shutoff valving to permit water to be drawn from such an enclosure if it is a source of pottable water or in the event that the pottable water in enclosure 25*a* is fully depleted. Sealable drains 125*a*, 125*b* (in phantom) can be provided through the floor 30 at the lowest point of each enclosure or through an exposed wall, if the wall is exposed above the ground at its base, to drain each enclosure by gravity. The layout of pipes and conduits is entirely diagrammatic. One of ordinary skill in the art will appreciate that piping such as 70, 70*a* would be better installed by being dropped from proximal the flooring 40 and/or passed within the foundation walls, rather than being passed horizontally through the foundation wall(s) at the bottom of the enclosure.

In addition, it may be desirable to provide electrical outlets suitable and conduits in the enclosure area during construction for use when the enclosure is not dedicated to water storage. This can be done by the use of waterproof conduit, which may be sealed to permit the future addition of switch and plug boxes or which may include switch and/or plug boxes sealed for immersion prior to use. Of course, such circuits would be rendered inactive at the electrical distribution box for the enclosure 10. Also, prewired conduit boxes, switches and plugs can be provided supported from the flooring 40. The conduit can be threaded or otherwise provided with a pivotal joint which would permit a length of the conduit and a box with a plug or switch at the end to be pivoted downwardly from between the load-bearing members of the flooring 40 to a desired location in any enclosure 25*a*.

Figure 2:
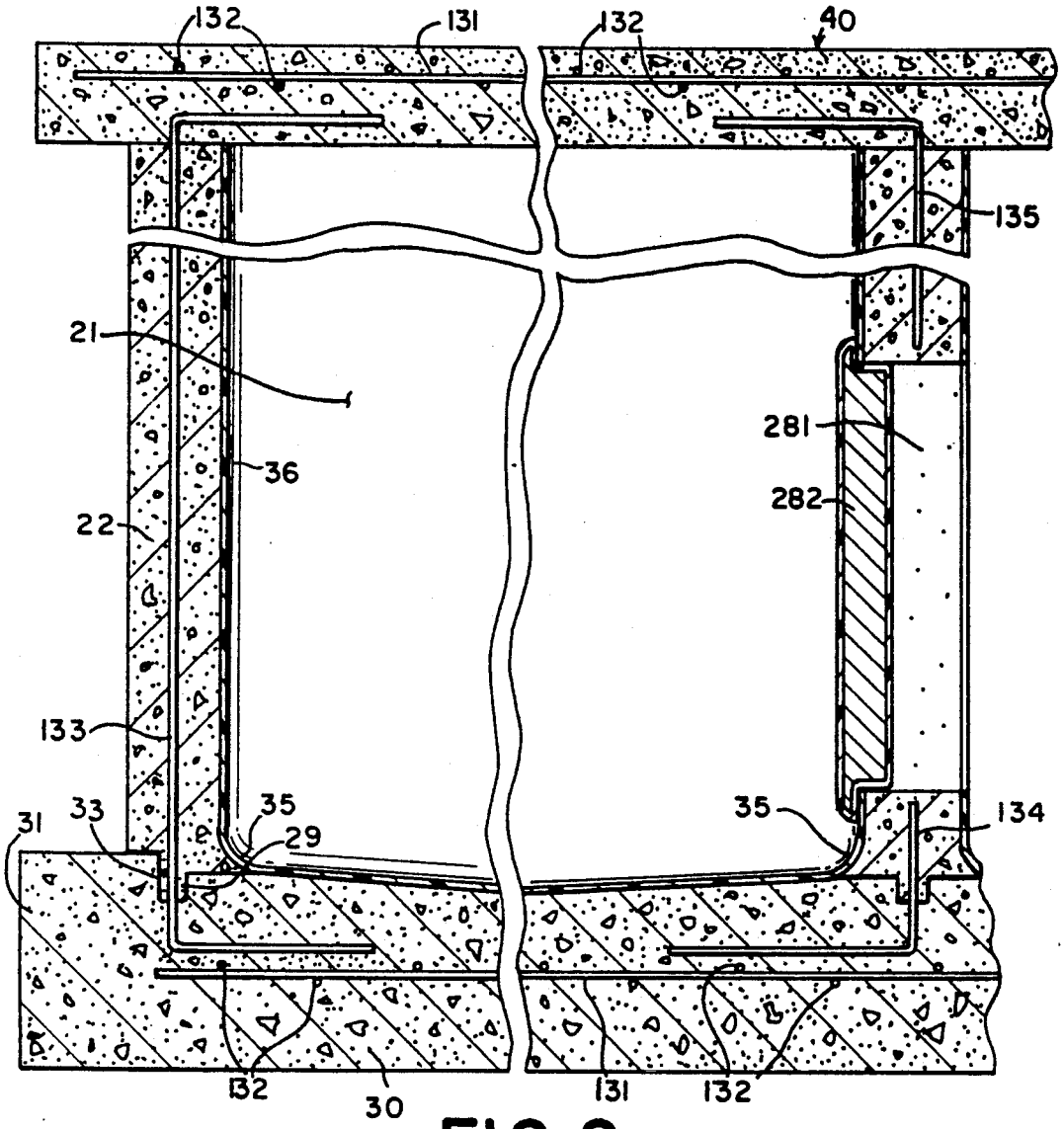
FIG. 2 is a more detailed, elevational, cross-sectional view of the building of FIG. 1 showing details of a preferred, reinforced concrete construction of the foundation and flooring.
Figure 4:
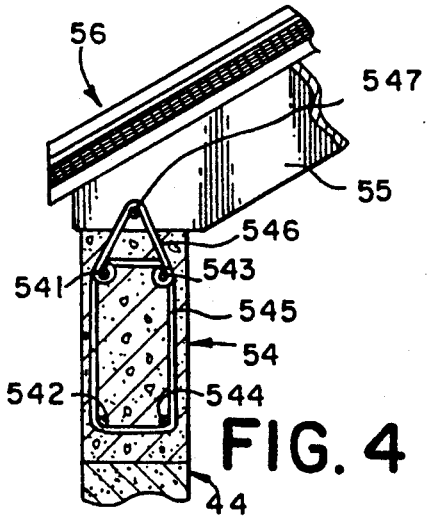
FIG. 4 is a vertical cross-sectional view along the lines 4—4 of FIG. 1.
Figure 3:
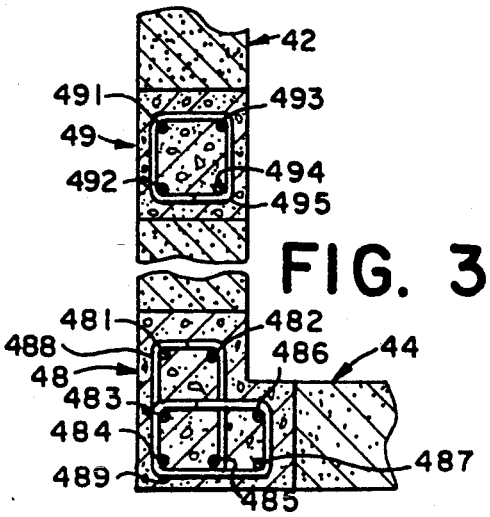
FIG. 3 is a plan cross-sectional view along the lines 3—3 of FIG. 1.

FIGS. 2 through 4 depict details of the preferred reinforced concrete construction of structure 10. FIG. 2 is a side elevation through walls 22, 28 near the intersection of each of those walls with wall 21. FIG. 3 is taken through the junctions of walls 42/44. FIG. 4 is taken along the top of wall 44.

Referring to FIG. 2, foundation floor 30 is preferably formed with an oversized footer portion 31, which extends around the lower perimeter of the enclosure 25 centered under each of the foundation walls 21–24 and under partition wall 28. Preferably, a variety of steel reinforcement bars strengthen each slab or wall element and interconnect the various load-bearing elements of the structure. For example, substantially horizontal reinforcement bars 131 are alternated at right angles with horizontal reinforcement bars 132 spanning the floor portion 30 of the enclosure. Bars 133, bent at right angles, are provided at regular intervals extending from the floor 30 upwardly into the foundation walls 22–25 and 28. Vertical bars 133 are provided at regular intervals along each of the walls 22–25. Preferably, their upper ends are turned horizontally into the slab forming the flooring 40 over the foundation 20. Horizontal bars 131, 132 cross in the flooring slab 40 as well. Shorter right-angle bent reinforcement bars 134 and 135 connect the upper and lower portions of the partition wall 28 with the foundation floor 30 and flooring slab 40, respectively. Portions of the partition wall 28, located immediately to either side of the passageway 281, preferably are reinforced by columns like column 49 in FIG. 4, which will be subsequently described. The remainder of partition wall 28 is reinforced in the manner of wall 22 in FIG. 2.

Referring to FIG. 3, the upper walls 41–44 preferably include continuous L-shaped columns 48 at each of the four corners of structure 10 where the walls 41–44 intersect one another. In addition intermediate columns 49 are preferably provided adjoining each window or door opening through each of the walls 41–44, on either side of the opening, and, preferably, at regular intervals along long, unbroken expanses of such walls 41–44. Each corner column 48 preferably is formed by at least seven generally rectangularly arrayed, continuous, vertical reinforcement bars 481–487, which are preferably extended continuously from the foundation floor slab 30 through the foundation walls 21–24, the upper flooring slab 40, and the upper load-bearing walls 41–45 and into ring beam 54, tying the columns 48, 49 into the roofing 50. The reinforcement bars preferably are tied together in sets of five bars 481–485 and 483–487 by rectangularly bent reinforcement bars 488 and 489, respectively, at regular vertical intervals, for example, six inches. Each intermediate column 49 is preferably formed by four reinforcement bars 491–494, which are also preferably extended continuously from foundation floor slab 30 into the roofing 50, and which are also preferably wrapped at regular height intervals, for example six inches, with reinforcement tie bars 495 bent into a square shape around the vertical bars 491–494. One of ordinary skill will understand that "continuous" reinforcement bars can be provided by tying together individual bars in a conventional fashion. If desired, concrete lintels can be provided between adjoining intermediate columns 49 or between a corner column 48 and an intermediate column 49 above each door opening and above and below each window opening. Preferably, each lintel would be provided with reinforcement bars extended horizontally into the adjoining vertical columns and tied into the reinforcement bars of those columns.

Referring to FIG. 4, in addition to the foregoing reinforcement of the foundation, flooring and upper walls, a reinforced concrete ring beam 54 is preferably provided around the top of the upper load-bearing walls 41–44, locking those walls 41–44 together and to the framework supporting the roofing 50. Beam 54 preferably includes at least four, rectangularly arranged, horizontally running reinforcement bars 541–544, which are ringed at regular horizontal intervals by generally rectangularly bent reinforcement bars 545. Additional reinforcement bars 546 are bent in an acute angle and are provided at regular intervals between adjoining joists 55 of the roofing 50 with extreme ends wrapped around the upper reinforcement bars 541, 543. Each bar 546 protrudes upwardly from the continuous, integral portion of the ring beam 54 into a space provided between the adjoining joists 55. The joists 55 support the outer roofing, which is indicated generally at 56. The bent reinforcement bar 546 is, in turn, tied to yet another long, continuous, horizontal reinforcement bar 547, which is passed between the sides of bar 546 forming its apex and through each of the joists 55. Preferably, concrete is installed between the adjoining joists 55, either as part of the pour of the ring beam 54 or in a subsequent pour. Ends of the reinforcement rods 481–487 and 491–494 of columns 48 and 49 are also extended into the ring beam 54 and may be turned transversely to the vertical direction in the ring beam 54 to further lock the bars 481–487 and 491–494 into the ring beam 54. If desired, the joists 55 can be formed from steel beams to further strengthen the roofing 50 and to avoid the necessity of replacing the joists in the extremely unlikely chance they would be damaged. If desired, the ring beam 54 can be extended down near or to the tops of the wall openings such as doors or windows to replace lintels. Preferably, upper walls 41–44 are formed of concrete formed onto a wire frame and the exposed portion of the roofing is provided by ceramic tiles to eliminate all combustables in the load-bearing components of the structure 10 and to provide strong, integral concrete walls. The preferred construction of structure 10, assuming it is placed on stable ground, will protect the structure from serious damage in a significant variety of potential natural calamities, including earthquake, brush fire, flood and insect attack, and further minimizes the need for structural maintenance.

While preferred embodiments have been described and several modifications thereto suggested, those of ordinary skill in this art may recognize that further changes could be made and features added to the above-described embodiments of the invention, without departing from the broad, basic inventive concepts thereof. It should be understood, therefore, that the invention is not limited to the particular embodiments disclosed but covers any modifications which are within the scope and spirit of the invention as defined by the appended claims.

I claim:

1. A ground-supported habitable structure comprising:

a foundation formed by one or more essentially water-impervious vertical walls defining an essentially closed perimeter;

an essentially water-impervious floor within the perimeter supported on the ground, the floor and foundation defining an open top water enclosure sitting on or at least partially in the ground;

flooring positioned on the foundation at least substantially covering the open top of the enclosure, the foundation supporting the flooring and any load supported by the flooring;

roofing exposed to the elements and supported six feet or more over the flooring to provide a habitable space between the roofing and the flooring, the roofing and any load supported by the roofing being transmitted to the ground through the foundation;

a catchment supported to receive rainwater running from the roofing; and at least one water-carrying conduit extending from the catchment to the enclosure interior so as to deposit rainwater running from the roofing into the enclosure beneath the flooring.

2. The habitable structure of claim 1 wherein said floor extends under at least one vertical wall of the enclosure perimeter, wherein a keyway is provided in the floor beneath the one wall and wherein one wall includes a key extending from the wall bottom and received in the floor keyway.

3. The habitable structure of claim 1 wherein the foundation further comprises an at least generally water-impervious, vertical load-bearing partition wall extending between opposing sides of the foundation perimeter so as to define two separate, adjoining water enclosures within the foundation.

4. The habitable structure of claim 3 further comprising a door opening through the partition wall and a removable cover at least essentially sealingly closing the door opening.

5. The habitable structure of claim 1 wherein an adjoining pair of nonparallel foundation walls form adjoining inner planar sides of the enclosure, and further comprising a curved surface connecting the adjoining inner planar sides and eliminating a corner between the adjoining inner planar sides of the enclosure.

6. The habitable structure of claim 1 further comprising waterproof sealing means within the enclosure curving between the vertical walls and floor at joints between the vertical walls and floor for sealing and avoiding corners at the joints.

7. The habitable structure of claim 1 further comprising an access way through the flooring to permit access to the enclosure through the flooring.

8. The habitable structure of claim 7 further comprising a stairway extending from the access way into the enclosure to the floor.

9. The habitable structure of claim 7 further comprising a water suction coupling positioned proximal the access way.

10. The habitable structure of claim 9 further comprising at least a second access way through the flooring on a side of the enclosure opposite the initial access way.

11. The habitable structure of claim 7 further comprising lighting located in or below the flooring for illuminating the enclosure.

12. The habitable structure of claim 1 further comprising means for removing water from a location within the enclosure proximal the enclosure floor.

13. The habitable structure of claim 12 wherein the enclosure floor is pitched downwardly so as to direct water at least generally towards the water removal location.

14. The habitable structure of claim 12 further comprising a conduit system within the structure below the roofing, the conduit system being coupled with the means for removing water to distribute the removed water to selected areas within the enclosure in the habitable space between the roofing and the flooring.

15. The habitable structure of claim 14 wherein the means for removing comprises a conduit extending from the removal location within the enclosure to a location outside the enclosure, and further comprising a suction pump coupled with the conduit outside the enclosure and a pressure pump having a pressure tank coupled with the suction pump to permit partial filling the tank with water from the enclosure and to pressurize gas trapped within the tank.

16. The habitable structure of claim 15 further comprising a filter coupled with the conduit system and with removal conduit so as to receive and filter water removed from the enclosure.

17. The habitable structure of claim 1 further comprising:

a rainwater catchment on the ground proximal the structure; and means for conducting rainwater from the ground catchment to the interior of the enclosure.

18. The habitable structure of claim 17 wherein the means for conducting further comprising a filter between the ground catchment and the enclosure.

19. The habitable structure of claim 1 wherein the foundation walls defining the perimeter are continuous pour reinforced concrete.

* * * * *